United States Patent [19]

Hara et al.

[11] Patent Number: 4,526,142

[45] Date of Patent: Jul. 2, 1985

[54] VARIABLE VALVE TIMING ARRANGEMENT FOR AN INTERNAL COMBUSTION ENGINE OR THE LIKE

[75] Inventors: Seinosuke Hara; Shunichi Aoyama; Kazuyuki Miisho, all of Yokosuka, Japan

[73] Assignee: Nissan Motor Company, Limited, Japan

[21] Appl. No.: 393,082

[22] Filed: Jun. 28, 1982

[30] Foreign Application Priority Data

Jun. 30, 1981 [JP] Japan ..... 56-98130[U]
Jun. 30, 1981 [JP] Japan ..... 56-98131[U]

[51] Int. Cl.[3] ..... F01L 1/24

[52] U.S. Cl. ..... 123/90.16; 123/90.44; 123/90.46

[58] Field of Search ..... 123/90.39, 90.15, 90.16, 123/90.43, 90.44, 90.45, 90.46, 90.27

[56] References Cited

U.S. PATENT DOCUMENTS 1,624,497 4/1927 McAllister ..... 123/90.46
1,701,563 2/1929 Griswold ..... 123/90.39
3,413,965 12/1968 Gavasso ..... 123/90.16
4,397,270 8/1983 Aoyama ..... 123/90.39
4,438,736 3/1984 Hara et al. ..... 123/90.16

FOREIGN PATENT DOCUMENTS 151106 11/1980 Japan ..... 123/90.16
506 1/1981 Japan ..... 123/90.16

*Primary Examiner*—Ira S. Lazarus
*Assistant Examiner*—R. S. Bailey
*Attorney, Agent, or Firm*—Lowe, King, Price & Becker

[57] ABSTRACT

The present invention features a variable valve timing arrangement having a zero valve clearance maintaining device which takes the form of either a springy finger-like extension provided on a valve timing control lever, which extension biases a rocker arm which operates the valve, against the valve stem until the rocker arm has been cammed to pivot by a predetermined amount; or an eccentric bush on which the control lever is mounted and a telescopic hydraulic cylinder arrangement which rotates the bush to press the lever against the rocker arm with a predetermined force adequate for maintain a zero valve clearance.

17 Claims, 12 Drawing Figures

VARIABLE VALVE TIMING ARRANGEMENT FOR AN INTERNAL COMBUSTION ENGINE OR THE LIKE

BACKGROUND OF THE INVENTION

1. Field of the Invention

The present invention relates generally to a valve train for an internal combustion engine or the like and more specifically to a variable valve timing arrangement therefor.

2. Description of the Prior Art

In a known arrangement such as shown in FIG. 1 of the present application, it has been proposed to operate a poppet valve, such as an inlet or exhaust valve of an internal combustion engine, via a rocker arm 1 which engages a cam 2 at one end and which is pivotally mounted on top of the stem 3 of the valve 4 at the other end. The upper surface of the rocker arm 1 is contoured and adapted to abut a lever 5. The point of abutment with the lever 5 defines the pivot or fulcrum point of the rocker arm. With this arrangement as the cam 2 rotates the rocker arm 1 is cammed to pivot about the fulcrum point defined by the aformentioned contact and induce the valve 4 to reciprocate. To vary the timing and degree of lift of the valve 4, a second cam 6 is provided and adapted to abut the lever 5. The second cam 6 is selectively rotated by a suitable hydraulic motor or the like (not shown). Thus, if the second cam 6 is rotated in a direction to urge the lever 5 to rotate counter clockwise (viz., downwardly as seen in the drawings) the degree of valve lift and the duration that the valve is open will be increased. Rotation of the cam which allows the lever to pivot in the clockwise direction (as seen in the drawings) reduces the valve lift and the duration for which the valve is open.

However, this arrangement has suffered from the drawbacks that the provision of the cam and lever arrangement above the rocker arm increases the overall height of the engine and as the lever/cam arrangement does not permit ready adjustment of the clearance between the rocker arm and the top of the valve stem, a rather large clearance must be provided to allow for thermal expansion, wear etc. This clearance unavoidably leads to the generation of so called "tappet noise", vibration and also tends to deteriorate the valve timing itself.

For a complete disclosure of the arrangement described above, reference may be made to U.S. Pat. No. 3,413,965 which issued on Dec. 3, 1968 in the name of J. M. Gavasso.

SUMMARY OF THE INVENTION

The present invention features a variable valve timing arrangement having a zero valve clearance maintaining arrangement which takes the form of either (a) a springy finger-like extension provided on a valve timing control lever which extension biases a rocker arm (which operates the valve) against the valve stem until the rocker arm has been cammed to pivot by a predetermined amount, or (b) an eccentric bush on which the control lever is mounted and a telescopic hydraulic cylinder arrangement with rotates the bush to press the lever against the rocker arm with a predermined force adequate for maintaining a zero valve clearance.

More specifically the invention features a valve train for inducing reciprocative motion in a valve which includes; a lever pivotally mounted at one end on a stationary shaft, a rocker arm engaging said lever to define a fulcrum point therebetween, said rocker arm engaging said valve at one end thereof, a first cam engaging the other end of said rocker arm, said first cam being arranged to periodically cause said rocker arm to pivot from a home position in a manner that said fulcrum point moves away from the axis of rotation about which said lever pivots, a second cam engaging said lever and means associated with said lever for maintaining a zero clearance between said rocker arm and said valve.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
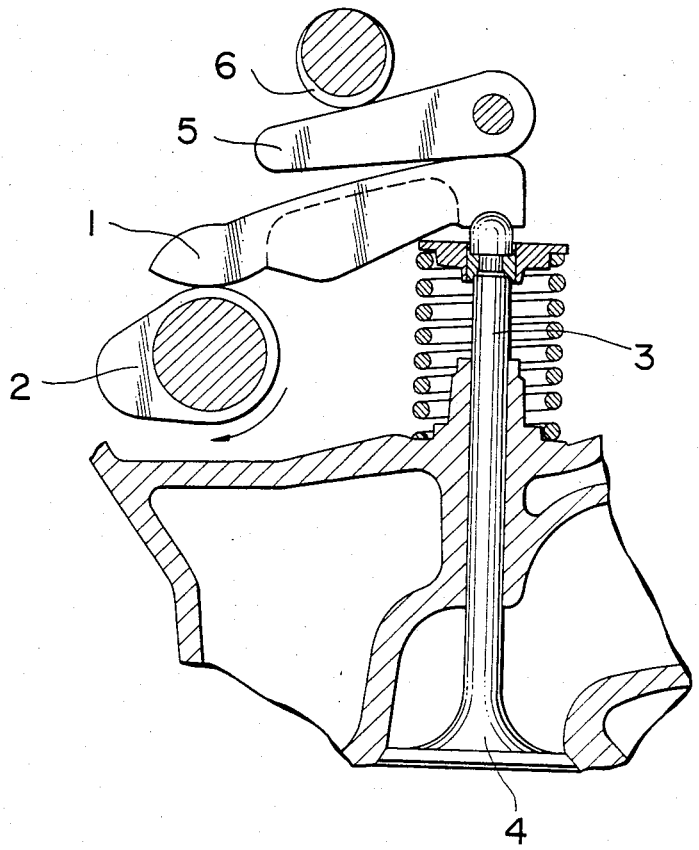
FIG.1 PRIOR ART
FIG. 1 is a partially sectioned view of the prior art arrangement discussed in the opening paragraphs of the instant disclosure.
Figure 2:
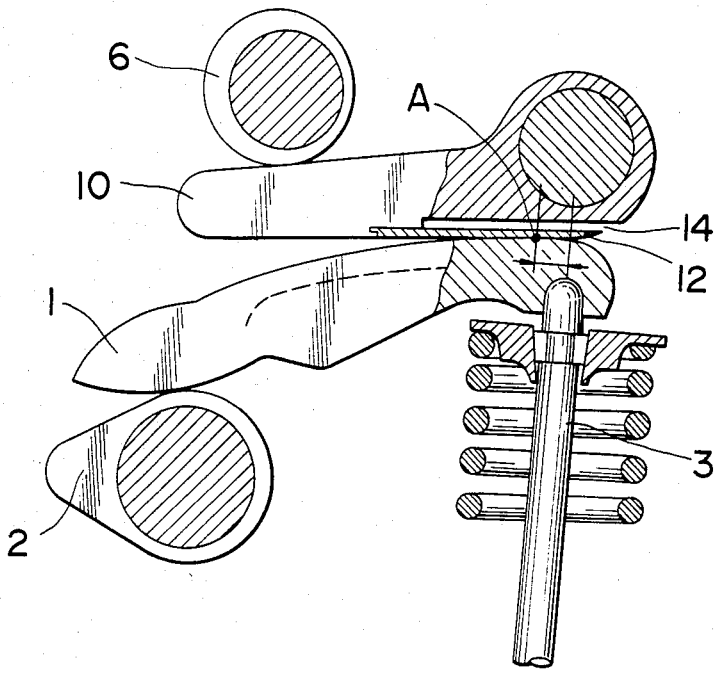
FIG. 2 is an elevation (partially in section) of a first embodiment of the present invention.
Figure 3:
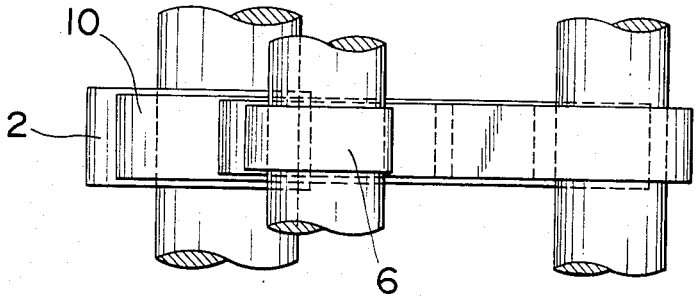
FIG. 3 is a plan view of the arrangement shown in FIG. 2.

Turning now to FIGS. 2 and 3 of the drawings a first embodiment of the present invention is shown. In this arrangement, which resembles that disclosed hereinbefore, a lever 10 is provided with a springy-finger like extension 12 which defines a narrow slit 14 between the lever and itself. This springy finger 12 is adapted to seat on top of the rocker arm 1 and bias the arm down onto the top of the valve stem 3 when the valve 4 is closed and the rocker arm 1 has assumed the illustrated position. Thus, as the cam 2 rotates and the lobe thereof engages and rotates the rocker arm, the fulcrum point A defined between the rocker arm and the lever shifts in the leftward direction away from the illustated position, the effect of the springy finger 12 diminishes to zero (viz., when the fulcrum point A moves to a point on the lever 10 having no resiliency).

With this arrangement the springy finger 12 is set to apply a predetermined preload on the valve stem 3 via the rocker arm in the illustrated position, so that if the valve stem should elongate due to thermal expansion, the springy finger 12 will be flexed slightly toward the lever proper, while in the case a clearance should tend to occur the finger will flex outwardly maintaining the desired zero clearance.

Figure 4:
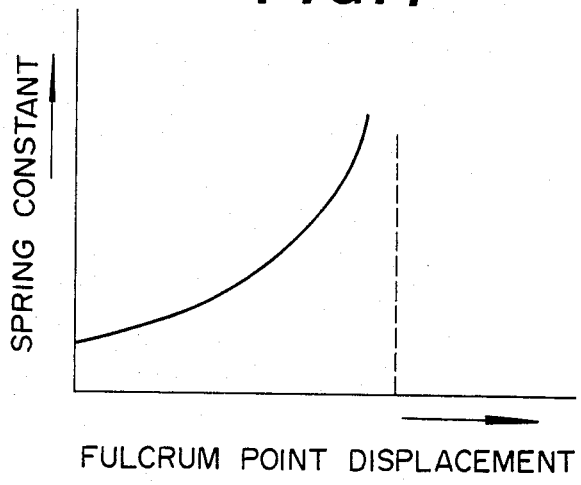
FIG. 4 is a graph showing, in terms of spring constant and displacement of the fulcrum point, the force applied to the valve stem by the first embodiment of the invention in order to maintain a constant zero valve clearance.

FIG. 4 is a graph showing the effect of the springy finger 12 in terms of spring constant and displacement of the fulcrum point. As the rocker arm 1 rotates the distance defined between the axis of the valve stem and the fulcrum point A increases and, as shown, upon the distance between the valve stem axis and the fulcrum point having reached a certain value, the spring constant maximizes and becomes constant. This of course happens as the fulcrum point approaches and/or exceeds the limit of the springy finger 12.

Figure 5:
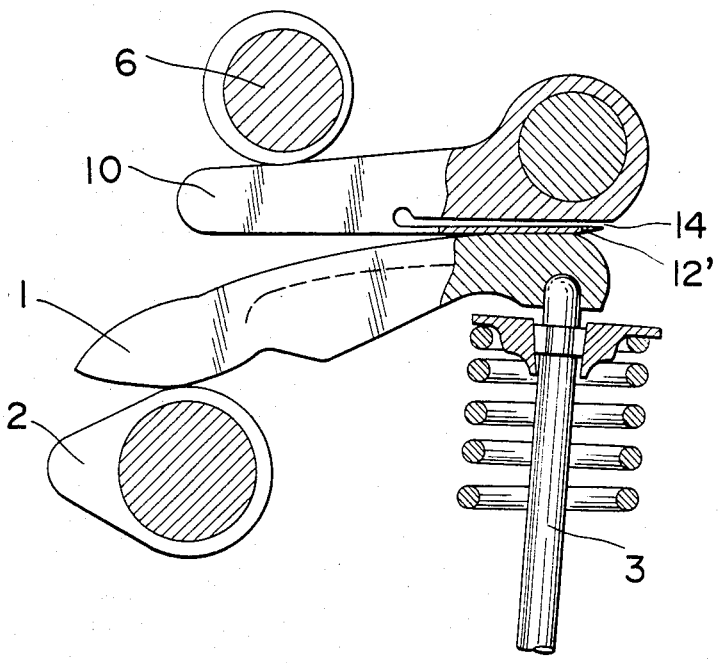
FIG. 5 is a partly sectioned elevation of a second embodiment of the present invention.

FIG. 5 shows a second embodiment of the present invention. This arrangement differs from the first in that the springy finger 12' is formed integrally with the lever.

Figure 6:
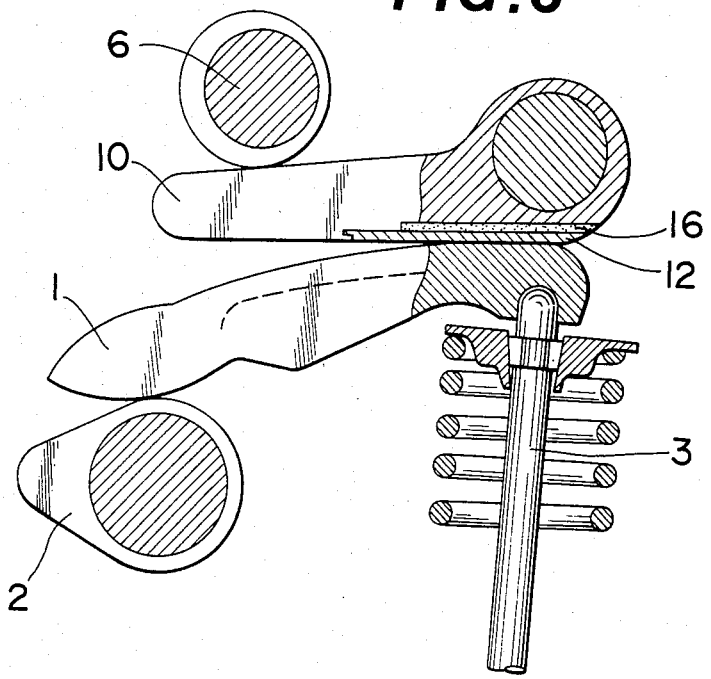
FIG. 6 is a partly sectioned elevation of a third embodiment of the present invention.

FIG. 6 shows a third embodiment of the present invention. In this arrangement an insert of viscoelastic material 16 such as nitrile-butadiene rubber (NBR) or other suitable elastomer which is both heat and oil resistant, is disposed in the slit. With this provision it is possible to tailor the biasing characteristics of the springy finger 12.

Figure 8:
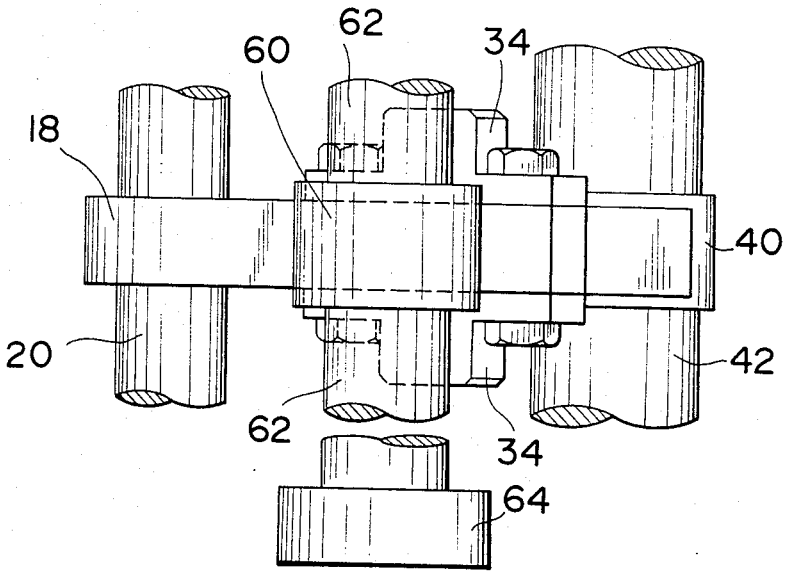
FIG. 8 is a plan view of the arrangement shown in FIG. 7.
Figure 7:
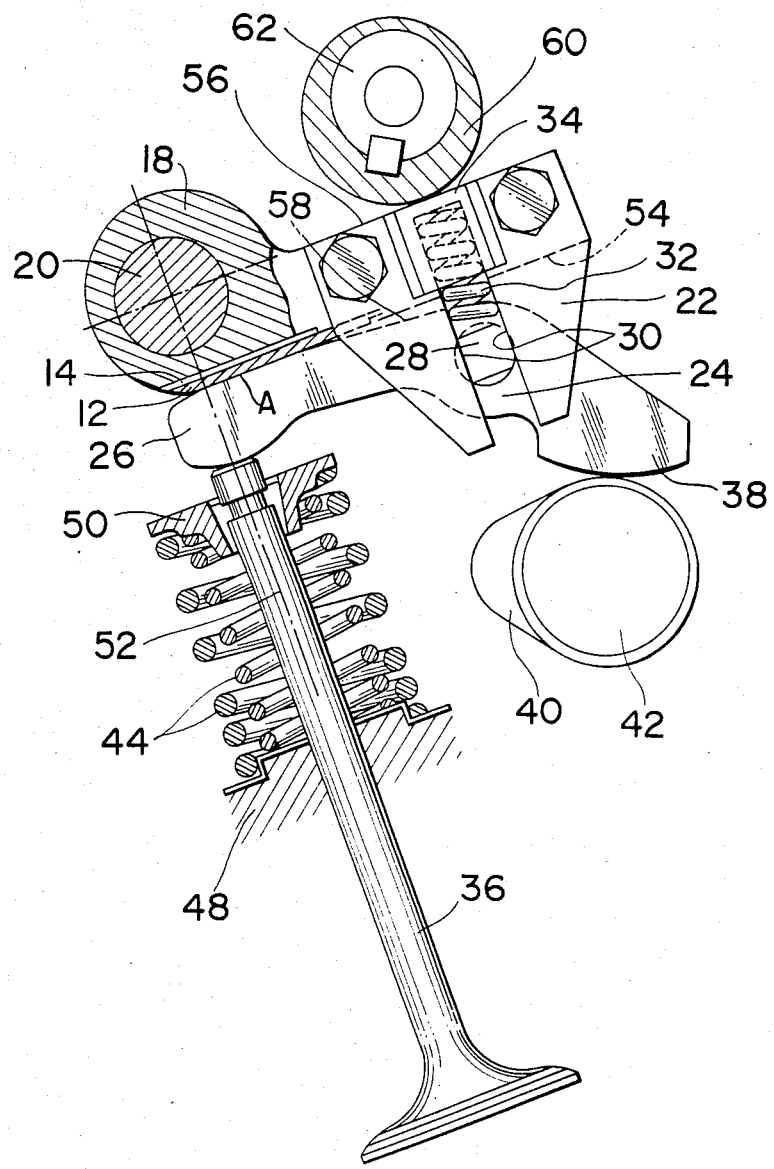
FIG. 7 is an elevation of a fourth embodiment of the present invention.

FIGS. 7 and 8 show a fourth embodiment of the present invention. In this arrangement, a lever 18 is pivotally mounted at one end thereof on a stationary shaft 20 and provided on either side thereof with a pair of guide forks 22 formed with guide slots 24.

A "bell crank lever-like" rocker arm 26 has a shaft 28 rotatably disposed through same at a location intermediate of the ends thereof. The ends of the shaft 28 which project out from either side of the rocker arm 26 are provided with flats 30 and are received in the guide slots so that the flats slide on the opposed walls thereof. A pair of springs 32 are disposed between retainers 34 formed in the upper portions of the guide forks and the ends of the rotatable shaft 28. One end of the rocker arm is adapted to abut the top of the stem of a poppet valve 36 (which as in the previous embodiments may be either an inlet or an exhaust valve) while the other end is provided with a cam follower portion 38 which rides on a cam 40 mounted on an overhead cam shaft 42. The valve 36 is biased toward a closed position by a set of nested coil springs 44 interposed between the cylinder head 48 of the engine and a spring retainer 50 disposed adjacent the top of the valve stem 52. The nested springs 44 are stronger than the springs 32 which serve to maintain the cam follower portion 38 of the rocker arm 26 in continuous contact with the cam 40.

The lever 18 is formed with two essentially flat surfaces (54,56) one of which is on the lower side of the lever (as seen in the drawings) while the other is on the upper side. The extrapolation of the flat surface 56 on the upper side in this instance passes through the axis of rotation of the lever 18 which is also intersected by the axis of the valve stem 52.

The upper surface 58 of the rocker arm 26 in contact with the lever 18 is gently contoured so as to define a line contact therebetween. This line contact serves as a fulcrum point of the rocker arm during operation of the valve train. A second cam 60 is mounted on a rotatable shaft 62 and arranged to abut the upper flat surface 56 of the lever 18. The shaft 62 is connected to a suitable servo 64 which controls the angular position of the second cam 60 with respect to the axis of rotation of the lever.

To allow for the various changes which occur during the various modes of the engine operation the lever is provided with a springy finger 12 thereon which defines a narrow slit 14 between the lever 18 and itself. The operation of this embodiment is such that when the valve is closed (as illustrated) the spring finger 12 is operative to apply a bias to the rocker arm 26 which maintains a zero valve clearance between it and the top of the valve stem.

With this arrangement when the cam 60 is rotated to the illustrated position (to produce maximum valve lift) wherein the minimum angle is defined between the axis of the valve stem 52 and the upper flat surface 56 of the lever 18, and the cam 40 rotates to bring the lobe thereof into contact with the cam follower portion 38 of the rocker arm, the rocker arm 26 is biased upwardly so as to compress the springs 32 slightly and is induced to roll along the lower surface 54 of the lever so that the line contact or fulcrum point A defined between it and the lever moves from the position shown in a rightward direction. Due to the retaining action provided by the guide forks 22 the amount of relative slip which occurs between the lever and the rocker arm is minimized. As in the previous embodiments, as the fulcrum point is displaced from the valve stem axis the bias applied to the rocker arm by the springy finger increases to a maximum.

Figure 9:
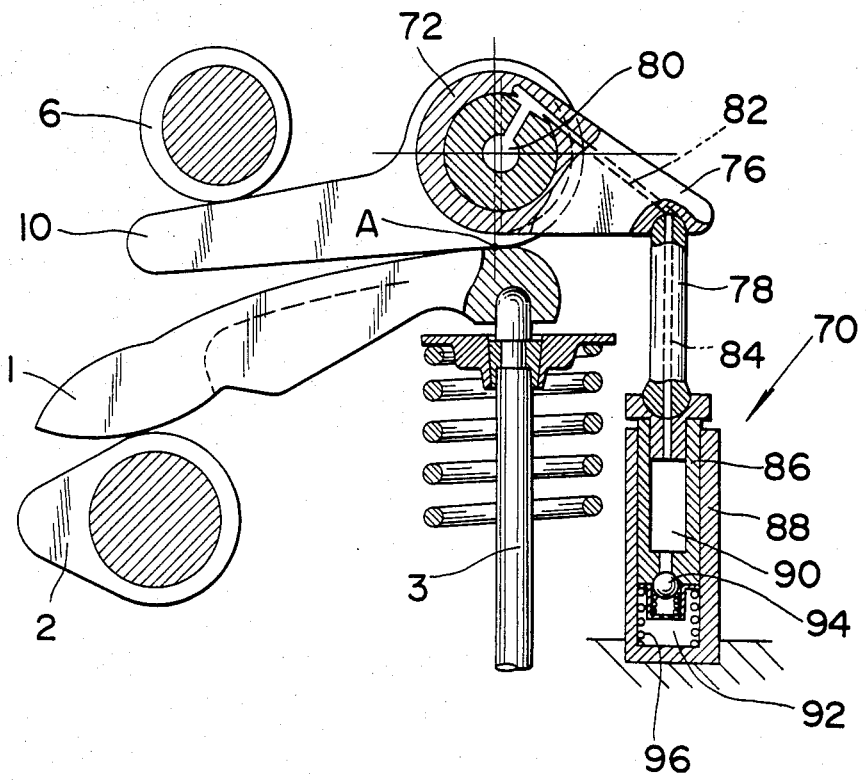
FIG. 9 is a partly sectioned elevation of a fifth embodiment of the present invention.
Figure 10:
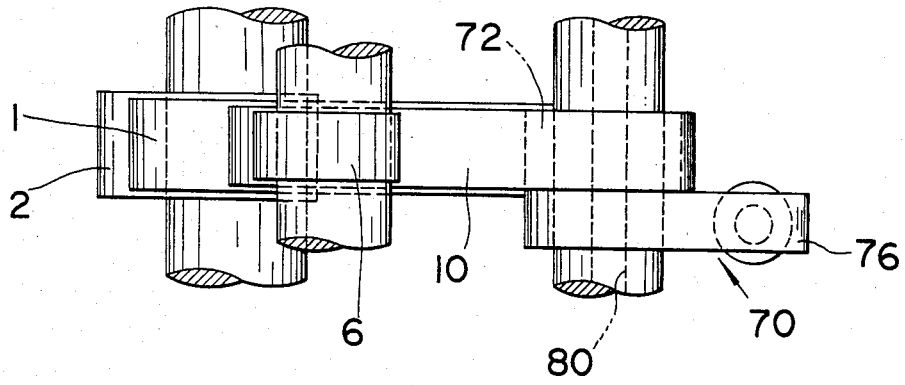
FIG. 10 is a plan view of the arrangement shown in FIG. 9.

FIG. 9 shows a fifth embodiment of the present invention. This embodiment resembles the first with the exception that the springy finger is replaced with a hydraulic cylinder and eccentric cam arrangement 70. In this embodiment, the lever 10 is mounted on the stationary shaft through an eccentric bush 72 which is connected to a hydraulic cylinder through an arm 76 and a pin 78 arrangement. An oil supply passage 80 is formed in the stationary shaft and adapted to communicate with the hydraulic cylinder through passages 82, 84 formed in the arm 76 and through the pin 78. The oil supply passage 80 is adapted to communicate with a source of hydraulic fluid under pressure such as the oil pump of the engine on which the valve train is mounted.

As shown the hydraulic cylinder consists of a piston 86 slidably received in a cylinder 88. A fixed volume chamber 90 is formed within the piston itself while a variable volume chamber 92 is defined in the cylinder 88 by the piston 86. A one-way check valve 94 is provided to control communication between the fixed and variable volume chambers 90, 92. A spring 96 is disposed in the variable volume chamber 92 for biasing the piston 86 upwardly (as seen in the drawings) to induce the arm 76 to rotate in the counter-clockwise direction. The eccentric bush 72 is so arranged that as the arm is rotated in the anti-clockwise direction, the axis of rotation of the lever 10 will be lowered thus tending to press the rocker arm 1 against the top of the valve stem 3, while if rotated in the clockwise direction, the lever will be raised with the reverse effect.

In operation, if a clearance develops between the valve stem 3 and the rocker arm 1, while the rocker arm is riding on the base circle of the cam 2, the bias applied to the eccentric bush 72 tending to rotate the same in the clockwise direction will diminish. Under these conditions the spring 96 disposed in the variable volume chamber 90 will tend to lift the piston 86 against the reduced bias applied thereto through the arm 76 and piston 86 to increase the volume of the variable volume chamber 92 and permit additional fluid (under pressure) to be introduced thereinto through the passages 82, 84 and one-way valve 94.

Thus, in accordance with the strength of the spring 96 and the pressure prevailing in the variable volume chamber 92, the arm 76 is rotated in the counter-clockwise direction to reduce the clearance to zero. During a valve lift operation when the lobe of the cam 2 engages and rotates the rocker arm, the reaction produced by the compression of the valve springs tends to rotate the eccentric bush 72 in the counter-clockwise direction. The reactor firstly drives the piston 86 slightly down into the cylinder 88 compressing the fluid trapped in the variable volume chamber 92 until a predetermined pressure is reached and the trapped fluid acts as a quasi-solid body and thereafter resists any further rotation of the bush. Due to the imperfect seal provided between the piston 86 and cylinder 88, a portion of the fluid trapped in the variable volume chamber 92 tends to be displaced, however upon the valve being allowed to close, the spring 96 moves the piston outwardly inducting fresh fluid to replace that displaced.

Figure 11:
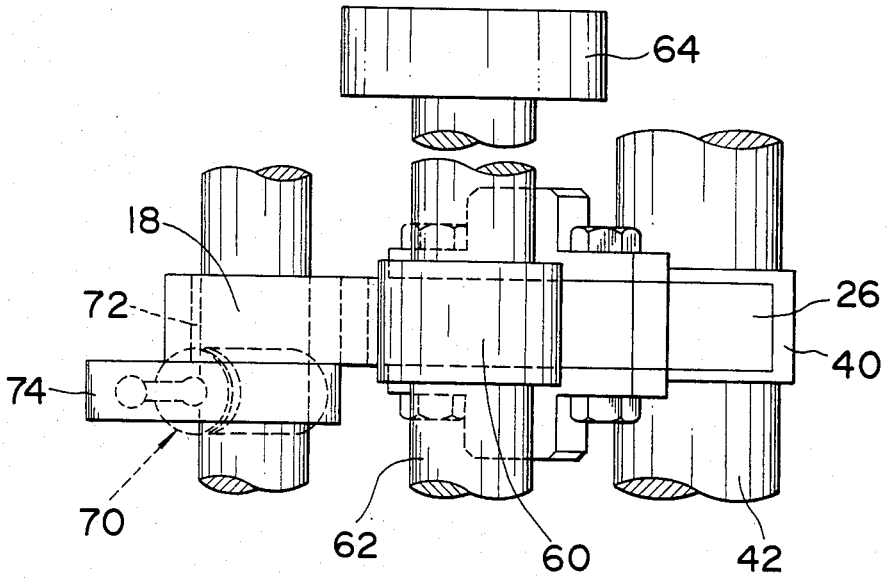
FIG. 11 is a plan view of a sixth embodiment of the present invention.
Figure 12:
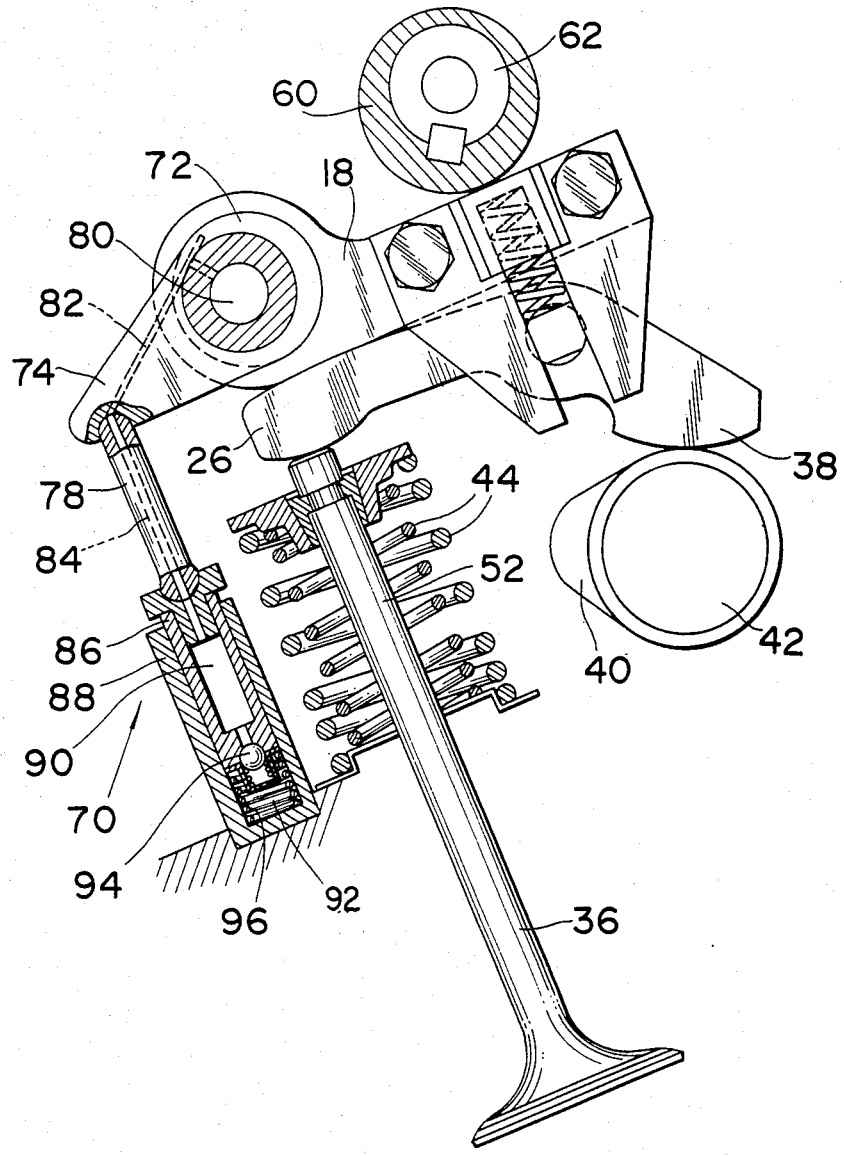
FIG. 12 is a partly sectioned elevation of the arrangement shown in FIG. 11.

FIGS. 11 and 12 show a sixth embodiment of the present invention wherein a hydraulic cylinder and eccentric cam arrangement 70 of the nature just disclosed is adapted to replace the springy finger arrangement of the fourth embodiment.

The arrangement is constructed and operates essentially in the same manner as that described. That is to say, should a clearance develop between the valve stem and the rocker arm, the hydraulic cylinder will tend to rotate the eccentric bush to reduce the clearance to zero. Conversely, as in the previous case, should an excessive surface pressure develop between the rocker arm 26 and the top of the valve stem 52, the increased bias applied to the piston 86 through the arm 76 and the piston will gradually displace fluid out of the variable volume chamber 92 through the aformentioned imperfect clearances to gradually allow the restablishement of the desired zero valve clearance maintaining equilibrium between the rocker arm 26 and top of the valve stem 52.

What is claimed is:

1. In a valve train for inducing reciprocative motion in a valve:

a lever pivotally mounted at one end on a stationary shaft;

a rocker arm engaging said lever to define a fulcrum point therebetween, said rocker arm engaging said valve at one end thereof;

first means, engaging one of a pair of elements comprising the other end of said rocker arm and said lever, for periodically causing the engaged element to pivot from a home position in a manner such that said fulcrum point moves away from the axis of rotation about which said lever pivots;

second means, engaging the other of said pair of elements comprising the other end of said rocker arm and said lever, for selectively controlling the angular position thereof with respect to said valve; and third means comprising biasing means mounted on said lever for maintaining a zero clearance between said rocker arm and said valve.

2. A valve train as claimed in claim 1, wherein said third means takes the form of a springy extension extending from said lever to define a slit between the extension and said lever, said springy extension being adapted to extend between said lever and said rocker arm and engage said rocker arm until said rocker arm has pivoted from said home position by a predetermined amount under the influence of said first means.

3. A valve train as claimed in claim 2, wherein said slit is filled with a viscoelastic material.

4. A valve train as claimed in claim 2 wherein said springy extension is formed integrally with said lever.

5. A valve train as claimed in claim 1 wherein said first means is a cam which is continuously rotatable.

6. A valve train as claimed in claim 1 wherein said second means is a cam which is selectively rotatable by an actuator.

7. A valve train as claimed in claim 1 wherein said reciprocative motion of said valve is in a direction passing through an axis of rotation of said lever.

8. A valve train as claimed in claim 1 wherein said first means comprises a cam, said rocker arm comprises a cam follower portion, and further including means for maintaining the cam follower portion of said rocker arm in continuous contact with said cam of said first means.

9. In a valve train for inducing reciprocative motion in a valve:

a lever pivotally mounted at one end on a stationary shaft;

a rocker arm engaging said lever to define a fulcrum point therebetween, said rocker arm engaging said valve at one end thereof;

first means, engaging one of a pair of elements comprising the other end of said rocker arm and said lever, for periodically causing the engaged element to pivot from a home position in a manner such that said fulcrum point moves away from the axis of rotation about which said lever pivots;

second means, engaging the other of said pair of elements comprising the other end of said rocker arm and said lever, for selectively controlling the angular position thereof with respect to said valve; and third means associated with said lever for maintaining a zero clearance between said rocker arm and said valve;

wherein said third means takes the form of;

an eccentric bush mounted on said stationary shaft and which pivotally supports said lever thereon;

a telescopic hydraulic cylinder which is readily extendible and slowly contractable; and a linkage which interconnects said cylinder and said bush so that extension of said cylinder rotates said bush and displaces said axis of rotation of said lever toward said valve.

10. A valve train as claimed in claim 9, wherein said telescopic hydraulic cylinder includes a piston disposed therein to define a variable volume chamber supplied with hydraulic fluid under pressure via passage means.

11. A valve train as claimed in claim 10, wherein said passage means is defined within said stationary shaft, said linkage and said piston, and wherein said passage means communicates with said variable volume chamber through a one-way check valve.

12. A valve train as claimed in claim 10 further comprising means defining a clearance between said piston and said cylinder through which hydraulic fluid may be slowly displaced from said variable volume chamber.

13. A valve train as claimed in claim 10 further comprising a spring disposed in said variable volume chamber for applying a bias to said piston which tends to extend said hydraulic cylinder.

14. In a valve train for inducing reciprocative motion in a valve:

a lever;

a stationary shaft providing a pivotal moount for one end of said lever;

a rocker arm engaging said lever to define a fulcrum point therebetween, said rocker arm engaging said valve at one end thereof;

first means, engaging one of a pair of elements comprising the other end of said rocker arm and said lever, for periodically causing the engaged element to pivot from a home position in a manner such that said fulcrum point moves away from the axis of rotation about which said lever pivots;

second means, engaging the other of said pair of elements comprising the other end of said rocker arm and said lever, for selectively controlling the angular position thereof with respect to said valve; and third means comprising biasing means mounted on said lever for maintaining a zero clearance between said rocker arm and said valve.

15. In a valve train for inducing reciprocative motion as recited in claim 14 wherein said valve and said lever are disposed on opposite sides of said rocker arm, in the vicinity of said one end thereof.

16. A valve train for inducing reciprocative motion in a valve as recited in claim 14 wherein said first means engages said other end of said rocker arm and said second means engages said lever.

17. A valve train for inducing reciprocative motion in a valve as recited in claim 14 wherein said third means engages said one end of said rocker arm.

* * * * *